US007393434B2

(12) United States Patent
Kornett

(10) Patent No.: US 7,393,434 B2
(45) Date of Patent: Jul. 1, 2008

(54) METHOD AND DEVICE FOR STABILIZING UNSEAMED LOOPS

(75) Inventor: Glenn Kornett, Bonneau, SC (US)

(73) Assignee: Albany International Corp., Albany, NY (US)

( * ) Notice: Subject to any disclaimer, the term of this patent is extended or adjusted under 35 U.S.C. 154(b) by 297 days.

(21) Appl. No.: 10/443,539

(22) Filed: May 22, 2003

(65) Prior Publication Data

US 2004/0231817 A1 Nov. 25, 2004

(51) Int. Cl.
*D21F 1/04* (2006.01)

(52) U.S. Cl. ..... 162/331; 162/199; 162/358.1; 162/358.2; 162/900; 24/33 A; 24/33 B; 277/358; 28/110; 428/193

(58) Field of Classification Search ..... 162/331, 162/199, 358.2, 358.1, 900, 904; 24/33 A, 24/33 P, 33 B; 277/358–361; 28/110; 428/193
See application file for complete search history.

(56) References Cited

U.S. PATENT DOCUMENTS

| | | | | |
|---|---|---|---|---|
| 433,791 | A * | 8/1890 | Jackson | 24/578.15 |
| 3,576,055 | A * | 4/1971 | Gisbourne | 16/225 |
| 6,491,794 | B2 | 12/2002 | Davenport | |

* cited by examiner

*Primary Examiner*—Mark Halpern
(74) *Attorney, Agent, or Firm*—Frommer Lawrence & Haug LLP; Ronald R. Santucci

(57) ABSTRACT

A method of stabilizing the seam loops of a papermaking fabric or other industrial fabric until the fabric is ready to be installed and seamed on a machine. Stabilizing the loops prevents torque imbalance and other forces from distorting the loop alignment over time, thereby making the loops easier to connect and seam when the fabric is ready to be installed.

8 Claims, 3 Drawing Sheets

METHOD AND DEVICE FOR STABILIZING UNSEAMED LOOPS

BACKGROUND OF THE INVENTION

1. Field of the Invention

The present invention relates to the papermaking arts. More specifically, the present invention relates to a device for stabilizing the seam loops of a papermaker's fabric until the fabric is seamed on a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Woven fabrics take many different forms. For example, they may be woven endless, or flat woven and subsequently rendered into endless form with a seam. Woven fabrics are typically in the form of endless loops, or are seamable into such forms, having a specific length, measured longitudinally therearound, and a specific width, measured transversely thereacross. Because paper machine configurations vary widely, paper machine clothing manufacturers are required to produce fabrics, and other paper machine clothing, to the dimensions required to fit particular positions in the paper machines of their customers. Needless to say, this requirement makes it difficult to streamline the manufacturing process, as each fabric must typically be made to order.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, about half of those used in press sections of the paper machines today are on-machine-seamable. Virtually all dryer fabrics have a seam. Some Paper Industry Process Belts (PIPBs) are contemplated to have an on machine seam capability, such as some transfer belts, known as Transbelt®. Installation of the fabric includes pulling the fabric body onto a machine and joining the fabric ends to form an endless belt.

A seam is generally a critical part of a seamed fabric, since uniform paper quality, low marking and excellent runnability of the fabric require a seam which is as similar as possible to the rest of the fabric in respect of properties such as thickness, structure, strength, permeability etc. In brief, the seam region of any workable fabric must behave as the body of the fabric with respect to characteristics such as permeability to water and to air, in order to prevent the periodic marking by the seam region of the paper product being manufactured on the fabric. In addition, press fabrics are subjected to compressive loads and the seam therefore must be able to withstand the repeated load/unload cycle. Despite the considerable technical obstacles presented by these requirements, it is highly desirable to develop seamable fabrics, because of the comparative ease and safety with which they can be installed.

To facilitate seaming, many current fabrics have seaming loops on the crosswise edges of the two ends of the fabric. The seaming loops themselves are formed by the machine-direction (MD) yarns of the fabric. A seam is formed by bringing the two ends of the fabric press together, by interdigitating the seaming loops at the two ends of the fabric, and by directing a so-called pin, or pintle, through the passage defined by the interdigitated seaming loops to lock the two ends of the fabric together.

Because these fabrics have a limited lifespan and require regular replacement, paper mills typically order replacement fabrics ahead of time. These fabrics may be stored in inventory for relatively long periods in the typically hot, wet conditions found in many paper mills. During shipment and storage the seam loops must be protected from damage. Further, the alignment and orientation of the seam loops can naturally shift over time due to environmental conditions and inherent forces in the fabric. Any distortion in the seam loops may result in seaming difficulties when the fabric is eventually installed. It is of primary importance that the seam be as easy to connect on the machine as possible.

All seamed fabrics exhibit some torque imbalance in their seam loops which depends, at least in part, on the weave pattern and fabric design. Various modifications to the woven base fabric patterns have been tried to prevent this imbalance from occurring. Although some of these modifications have had limited success, the seam loops still distort and tilt if the fabric ages sufficiently and the forces remain sufficiently high. Unfortunately, adjacent loops "distort" differently from one another.

Presently, following inspection but prior to shipment, a monofilament or metal wire of a certain diameter is inserted through the seam loops in both the edges of the fabric. This wire is typically referred to as a protection cable. The function of the protection cable is to prevent the seaming loops from being damaged. Since this cable is generally installed and removed as one piece, the diameter of the cable must be significantly smaller than the clearance of the loops to minimize friction and allow for the cable to pass through the loops.

Because the protection cable is of a smaller diameter than the seam loops, the loops can still move and distort in their alignment. This distortion and tilt will continue until the loops bind on the outside edges of the protection cable. The distorted loops make it difficult to interdigitate and thread a pintle through the loops to form the seam. Hence, fabrics which have been in storage for long periods often have significantly distorted seam loops which are very difficult to seam. Depending upon yarn material, form, weave pattern, etc. seam loop distortion can occur relatively soon after the seam loops are formed. An advantage of having non-deformed seam loops is the speed and ease of seaming when installing the fabric on a paper machine.

Therefore, a need exists for a method of protecting and stabilizing the orientation of the seaming loops until a fabric is ready for installation and seaming on a papermaking machine.

SUMMARY OF THE INVENTION

The present invention is a device for stabilizing unseamed loops in a seamable fabric. The device prevents torque imbalance and other forces from distorting the seam loops over time, thereby making the loops easier to connect and seam.

Accordingly, the present invention is a device for stabilizing the seam loops of an on-machine-seamable fabric until installation on a paper machine. The device has a plurality of stabilizing elements connected and spaced for interdigitating with the seam loops on a seam edge of the fabric. The device further has a protection cable which is inserted through the seam loops and interdigitated stabilizing elements, thereby binding the stabilizing device to the seam loops. The interdigitated stabilizing elements lock the seam loops into an orientation that restricts movement of the seam loops in a cross machine direction (CD). Preferably, the plurality of stabilizing elements act to stabilize the seam loops in a desired orientation that is easier and faster to seam than the natural orientation of the seam loops.

Other aspects of the present invention include that the plurality of stabilizing elements may be loops of a spiral type device. The plurality of stabilizing elements may alternatively be seam loops on an edge of a strip of seamable fabric. The fabric is preferably a press fabric having a flap side and a no flap side with the device being interdigitated with the seam loops from the no flap side of the fabric. If the fabric has first and second seam edges, a first device may be interdigitated with the seam loops of the first seam edge and a second device may be interdigitated with the seam loops of the second seam edge. Alternatively, a first edge of the device may be interdigitated with the seam loops of the first seam edge and a second edge of the device may be interdigitated with the seam loops of the second seam edge.

Another embodiment of the device is an extruded, formed element with alternating recesses and protrusions, the protrusions having either a circular or non-circular cross-sectional geometry. The protrusions typically have a void which can interdigitate with the seam loops, allowing a protective cable to be inserted.

Another embodiment of the present invention is a method of stabilizing seam loops on an on-machine-seamable fabric until installation on a paper machine. The method includes the steps of interdigitating a plurality of stabilizing elements of a stabilizing device with the seam loops on a seam edge of the fabric. A protection cable is then inserted through the seam loops and interdigitated stabilizing elements. This binds the stabilizing device to the seam loops. The stabilizing device locks the seam loops into an orientation so as to restrict movement of the seam loops in a cross machine direction (CD).

The method may further comprise the steps of removing the protection cable from the seam loops of the seam edge and removing the stabilizing device from the seam loops of the fabric. Thereafter, the fabric is ready for installation and seaming.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
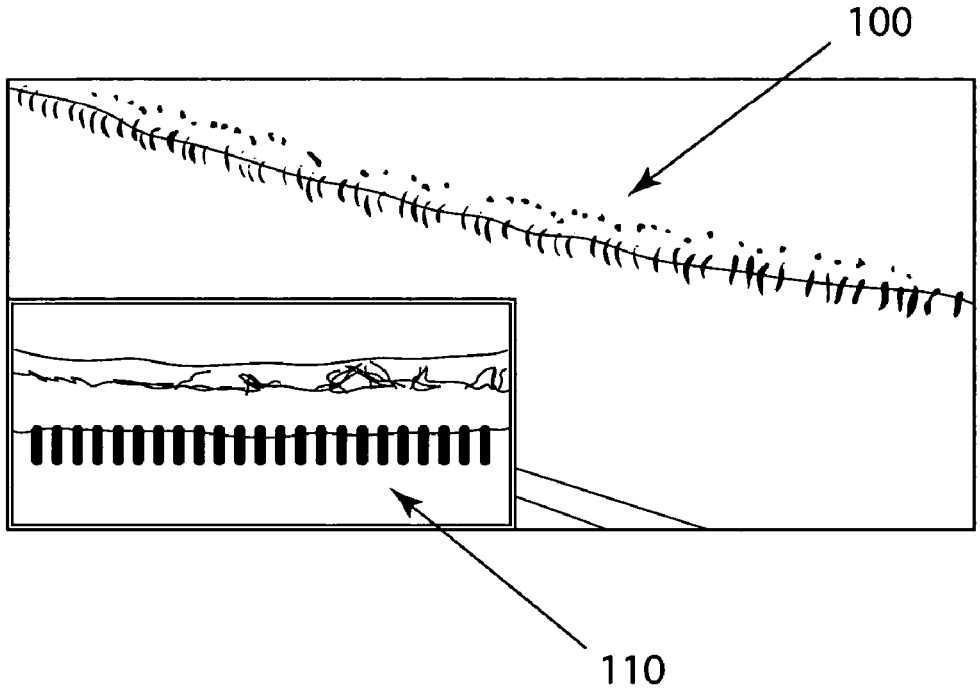
FIG. 1 is a view of an uninstalled fabric's seam loops after storage for 20 months, and inset is a view of a fabric sample card having stabilized seam loops stored for the same 20 month period.

FIG. 1 is a view of an uninstalled fabric's seam loops 100 after storage for 20 months. Note the uneven alignment/orientation of the loops resulting from the forces inherent in the fabric distorting the loops over time. The inset in FIG. 1 is a view of a fabric sample having stabilized seam loops 110 stored for the same 20 month period. Although the fabric sample has the same inherent forces as the fabric, in this instance the fabric sample had its flap and no flap sides pinned together during the storage period. This pinning effectively eliminated any space for the loops to twist and distort their alignment. Hence, the loops were stabilized and have therefore maintained their alignment. However, it is not always practical or convenient to pin the flap and no flap sides of a fabric together to protect the loops.

The present invention essentially accomplishes an equivalent loop stabilization in a slightly different manner. Before shipment, the present device is inserted into the seam loops on each side of the fabric, to keep the loops stable by "locking" them into place so as to restrict their movement in the cross machine direction (CD). In fact, the present device may even be designed to intentionally adjust the loops into a more desirable orientation than is naturally produced. In this manner, the device could reorient the loops to allow for faster seaming.

Figure 2:
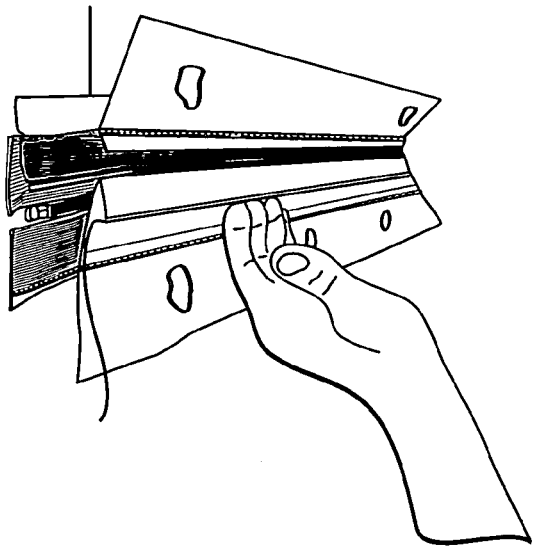
FIG. 2 is a view showing a press fabric having a stabilizing device according to the present invention installed in the seam loops on the no flap side.
Figure 3:
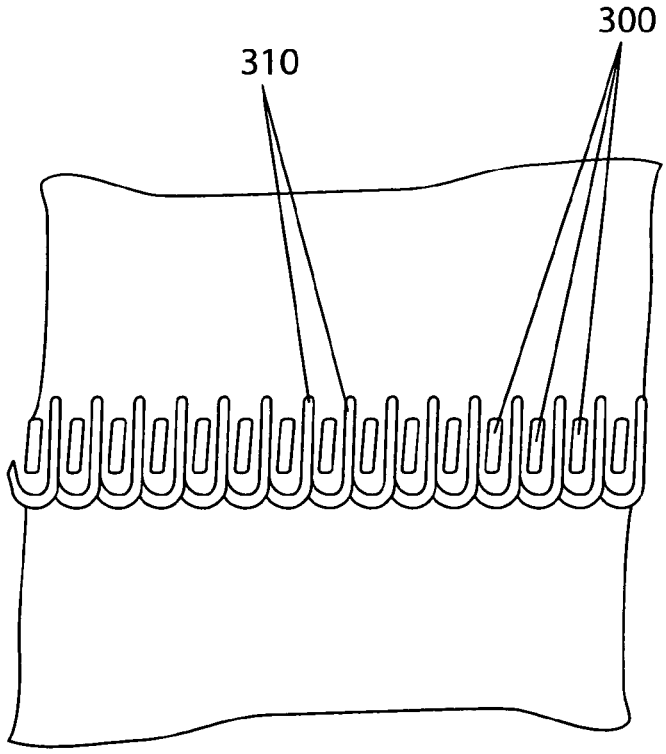
FIG. 3 is a close-up view of a fabric having a spiral type stabilizing device according to the present invention installed in the seam loops.

A preferred embodiment of the invention is a spiral type stabilization device, as shown in FIGS. 2 and 3. FIG. 2 is a view showing a press fabric having a stabilizing device according to the present invention being installed in the seam loops on the no flap side. The loops of the spiral device are interdigitated with the seaming loops of the fabric and the protection cable is inserted to bind the spiral loops and the seam loops together. In FIG. 2, a 0.50 mm spiral is being inserted between the 0.50 mm spiral loops of a press fabric, prior to shipment. Normally, only the protection cable would be installed in the seam loops. Here the operator is inserting the spiral stabilizer according to the present invention and connecting the spiral loops to the seam loops with the protection cable (or pintle).

FIG. 3 is a close-up view of a fabric having a spiral type stabilizing device 310 according to the present invention installed in the seam loops 300. A protection cable is inserted through both the loops and the spirals to lock the device in place. Note there is limited space for the loops to twist and distort their alignment before contacting the spirals on either side. From FIG. 3, it is evident that this method can be used to significantly restrict the movement of seam loops over time.

Once the protection cable is removed, as is customary prior to seaming, the spiral device will virtually fall out of the seam and may be discarded or reused. At this point, any torque imbalance in the fabric can once again impact the alignment of the loops, but since these forces generally takes days or weeks to impact seaming and the fabric will likely be seamed within minutes, the effects of any imbalance will be of a degree which should not impede the seaming process.

Figure 4A:
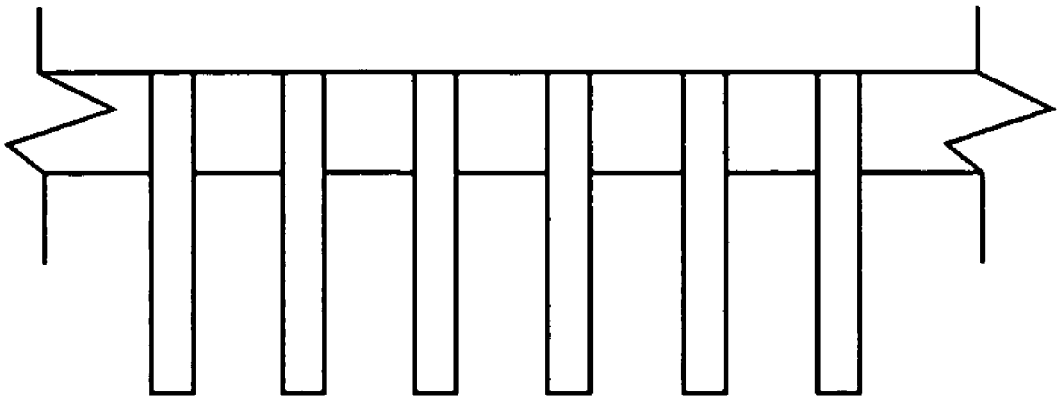
FIG. 4 are close-up a) front and b) side views of an extruded element stabilizing device according to the present invention.
Figure 4B:
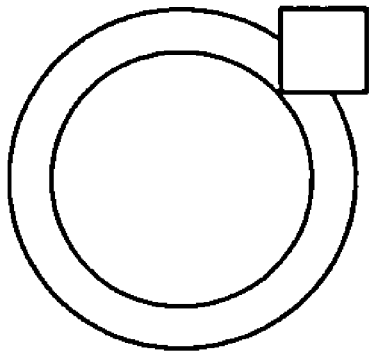

FIG. 4 shows close-up views of an extruded or formed element according to the present invention. The front view (a) clearly shows the spaced circular protrusions that will be inserted between the seaming loops. Side view (b) shows how the circular protrusions are aligned through which the protection cable can be inserted to bind the element to the fabric end, thereby protecting the seaming loops.

The present invention is intended to cover all types of devices for stabilizing unseamed loops in a seamable press fabric to prevent torque imbalance or other forces from distorting the loops over time; thereby making the loops easier to connect and seam. Specifically, the present invention may include metal or plastic springs, clipper hook seam material, notched rods, combs, reeds, or any other devices which may be used to stabilize the seaming loops of a fabric after shipment and prior to installation on a paper machine. Various sizes, shapes, "loop" angles, and raw material types can be combined with various seam designs to offer the optimum loop orientation over time. Further, the present stabilizing device may have a circular or noncircular cross-section (including a rectangular or zipper-like cross-section).

For example, the proposed device may simply consist of a strip of seamable fabric having seaming loops on either side. The loops of this fabric strip may be meshed into each side of the seam being shipped and held in place by a protection cable.

Alternatively, the device may be formed of shaped metal or polymers of any form, combined with shaped protection cables of any form to fill the void space between the loops, yet still allow for easy removal.

The "element" can also be in sections of any length, not one whole piece as long as the total length of the sections equals the width of the fabric seam.

Accordingly, the present invention should not be construed as being limited to the type devices shown in the accompanying figures.

Furthermore, while the device has particular utility for press fabrics, the device can be used on any number on-machine-seamable papermaking fabric such as forming fabrics, dryer fabrics, TAD fabrics, pulp forming and pressing fabrics, as well as some Paper Industry Process Belts. It is also foreseen to use the device on other industrial fabrics such as those used to produce nonwovens by processes such as hydroentangling or melt blowing.

Thus by the present invention its objects and advantages are realized and although preferred embodiments have been disclosed and described in detail herein, their scope should not be limited thereby; rather their scope should be determined by that of the appended claims.

What is claimed is:

1. A device for stabilizing seam loops of an on-machine-seamable fabric comprising:

a plurality of stabilizing elements connected and spaced for interdigitating with the seam loops on a seam edge of the fabric; and a protection cable for insertion through the seam loops and interdigitated stabilizing elements; thereby binding the device to the seam loops, wherein the plurality of stabilizing elements are linked to each other in a continuous manner.

2. The device according to claim 1, wherein the plurality of stabilizing elements are spiral type devices.

3. The device according to claim 1, wherein the plurality of stabilizing elements are seam loops on an edge of a strip of seamable fabric.

4. The device according to claim 1, wherein the plurality of stabilizing elements are extruded or formed devices with protrusions having a circular geometry.

5. The device according to claim 1, wherein the plurality of stabilizing elements have a noncircular cross-section.

6. The device according to claim 1, wherein the fabric is a forming fabrics, press fabric, dryer fabric, pulp forming or pressing fabric, TAD fabric, Paper Industry Process Belt, or a fabric used in the production of nonwovens.

7. The device according to claim 1, wherein the fabric has first and second seam edges; and a first device is interdigitated with the seam loops of the first seam edge and a second device is interdigitated with the seam loops of the second seam edge.

8. The device according to claim 1, wherein the fabric has first and second seam edges; and a first edge of the device is interdigitated with the seam loops of the first seam edge and a second edge of the device is interdigitated with the seam loops of the second seam edge.

* * * * *